US009334146B2

(12) United States Patent
Meijer et al.

(10) Patent No.: US 9,334,146 B2
(45) Date of Patent: May 10, 2016

(54) STACKER AND METHOD FOR DISPLACING GOODS

(71) Applicant: Gebr. Meijer St. Jabik B.V., Sint Jacobiparochie (NL)

(72) Inventors: Hendrik Meijer, Sint Jacobiparochie (NL); Folkert De Graaf, Sint Jacobiparochie (NL)

(73) Assignee: Gebr. Meijer St. Jabik B.V., Sint Jacobiparochie (NL)

( * ) Notice: Subject to any disclaimer, the term of this patent is extended or adjusted under 35 U.S.C. 154(b) by 99 days.

(21) Appl. No.: 14/351,282

(22) PCT Filed: Oct. 11, 2012

(86) PCT No.: PCT/NL2012/050709

§ 371 (c)(1),
(2) Date: Apr. 11, 2014

(87) PCT Pub. No.: WO2013/055214

PCT Pub. Date: Apr. 18, 2013

(65) Prior Publication Data

US 2014/0301815 A1 Oct. 9, 2014

(30) Foreign Application Priority Data

Oct. 12, 2011 (NL) ..... 2007576

(51) Int. Cl.
*B66F 9/12* (2006.01)
*B66F 9/19* (2006.01)

(52) U.S. Cl.
CPC .... *B66F 9/12* (2013.01); *B66F 9/19* (2013.01)

(58) Field of Classification Search
CPC ..... B66F 9/12; B66F 9/19
USPC ..... 280/43.12, 79.11
See application file for complete search history.

(56) References Cited

U.S. PATENT DOCUMENTS

| | | | | |
|---|---|---|---|---|
| 2,570,726 | A * | 10/1951 | Smith | B66F 9/12 414/437 |
| 7,435,047 | B2 * | 10/2008 | Meijer | B60P 1/52 193/35 R |
| 8,752,846 | B1 * | 6/2014 | White | B62B 3/008 280/43.12 |
| 2004/0191047 | A1 | 9/2004 | Meijer | |
| 2007/0048117 | A1 * | 3/2007 | Lawless | B66F 9/195 414/619 |

FOREIGN PATENT DOCUMENTS

| | | |
|---|---|---|
| CN | 201873492 U | 6/2011 |
| NL | 1014147 | 7/2001 |
| WO | 02100760 A1 | 12/2002 |

* cited by examiner

*Primary Examiner* — Kaitlin Joerger
(74) *Attorney, Agent, or Firm* — The Webb Law Firm

(57) ABSTRACT

A stacker includes a frame, forks connected to the frame and provided with a support part having at least one support wheel, and a carrier part provided movably relative to the support part for carrying the goods for displacement. The carrier part is provided with a double roller device. The double roller device includes a number of first roller elements located a distance from each other and having a roll surface, and a number of second roller elements located above the first roller elements and having a roll surface. The roll surface of the first roller elements lies against the roll surface of the second roller elements. The roller elements engage movably in vertical direction on the frame in a guided manner so as to extend the second roller elements in selective manner above the upper surface of the load platform.

8 Claims, 7 Drawing Sheets

STACKER AND METHOD FOR DISPLACING GOODS

CROSS-REFERENCE TO RELATED APPLICATIONS

This application is the United States national phase of International Application No. PCT/NL2012/050709 filed Oct. 11, 2012, and claims priority to Netherlands Patent Application No. 2007576 filed Oct. 12, 2011, the disclosures of which are hereby incorporated in their entirety by reference.

BACKGROUND OF THE INVENTION

1. Field of the Invention

The present invention relates to a stacker for displacing goods. Such a stacker is usually used in logistics centres for displacing goods, for instance on pallets or other carriers.

2. Description of Related Art

Stackers are known in practice. Known stackers are usually formed as a pallet truck provided with a mast to enable upward displacement of the forks of the stacker. Support parts of the forks rest on the ground surface here in order to prevent a stacker tipping over. In practice the pick-up of goods with a stacker usually requires pushing and sliding the forks under the goods. This is found to be particularly difficult in practice for goods on so-called slip sheets and low plastic carriers or supports.

SUMMARY OF THE INVENTION

The object of the present invention is to improve handling and particularly displacement of goods in respect of efficient pick-up of goods placed on slip sheets and low carriers.

This object is achieved with the invention by providing a stacker for displacing goods, the stacker comprising:

a frame;

forks connected to the frame and provided with a support part having at least one support wheel, and a carrier part provided movably relative to the support part for carrying the goods for displacement, wherein the carrier part is provided with a double roller device, wherein the double roller device comprises a number of first roller elements located a distance from each other and having a roll surface, and a number of second roller elements located above the first roller elements and having a roll surface, and wherein the roll surface of the first roller elements lies against the roll surface of the second roller elements, wherein the roller elements engage movably in vertical direction on the frame in a guided manner so as to extend the second roller elements in selective manner above the upper surface of the load platform.

By providing forks with a carrier part and a support part which are movable relative to each other, wherein in practice the support part rests on a ground surface using a support wheel, the carrier part can carry the goods for displacement. Picking up and setting down of goods are greatly simplified according to the invention by providing the carrier part with a double roller device.

The double roller device has substantially two positions. In a first position, when goods are being carried during transport, the second or upper roller elements will have no contact with these goods and the frame will be guided to a lower position. The goods are therefore carried by the carrier part of the forks. In a second position the roller elements of the lower row engage on the ground surface and the second or upper roller elements will engage on the goods. The second position is intended particularly for picking up and setting down of goods.

The stacker according to the invention in fact comprises a second set of roller elements with a roll surface which are arranged above a first set, wherein the roll surface of the first set of roller elements lies against the roll surface of the second set of roller elements. When the load platform does in fact roll with the first roller elements over the supporting surface, the roll surfaces of both roller elements make contact such that the second roller elements also roll. In the case of a load platform moving to the right the first roller elements roll clockwise. The second roller elements on the contrary roll counter-clockwise.

The second roller elements protrude partially from the internal part of the load platform through recesses in the upper surface of the load platform. The protruding roll surfaces of the second roller elements bear the cargo arranged on the upper side of the load platform. The rolling movement of the second roller elements ensures that the cargo remains stationary relative to the supporting surface, while the load platform is moved under the cargo. The cargo is thus scooped onto the load platform.

After placing of the goods on the forks the carrier part can be moved upward and the stacker can be displaced with the goods to the desired position for the goods. During set-down the carrier part will be moved downward so that it once again rests on the support part and, with a rearward displacement, the goods will be set down with a reverse movement relative to the pick-up.

The roller elements can be assembled with the same diameter. The diameter of a roller element of the first set is substantially equal to the diameter of a roller element of the second set with which the roll surface of the first roller element is in contact. This measure ensures that the relative speed of the cargo relative to the ground surface is zero.

The roller elements are particularly rollers, although other elements such as balls may also be suitable.

In an advantageous preferred embodiment according to the present invention the roller elements are connected in groupwise manner to a plate element provided movably relative to the carrier part.

Groupwise or modular provision of the roller elements makes it possible to allow such a module to move between a first and a second position relative to the carrier part. This achieves that the whole module moves as a unit from a first to a second position, and vice versa. A further advantage hereof is that the mounting and possible replacement of the roller elements can be performed in more effective manner.

In an advantageous preferred embodiment according to the present invention a second double roller device is provided on the front side of a stacker.

The products can be picked up in simple manner by providing the first double roller device according to the invention on the rear side close to the frame and providing an additional second double roller device on the front side. When the forks are inserted under the goods, use is made of the second double roller device.

In the case of the second double roller device the diameter of the roller elements preferably decreases toward the front side of the stacker. The thickness of the fork therefore decreases on the front side as seen from the rear to the front. The diameter of the roller elements then decreases proportionally in the same way from the rear toward the front. This simplifies insertion of the forks under the goods. This particularly achieves that the forks can be placed in simple manner not only under standard pallets, but also under slip sheets and other carrier elements. The second double roller device is preferably provided on the front side of the carrier part on which goods do not rest during displacement.

In an advantageous preferred embodiment according to the present invention the stacker is provided with a nose movable relative to the fork.

The forks can be placed in effective manner under the goods by being provided with a nose on the front side. By providing this nose movably according to the invention, and this particularly such that the upper surface of this nose can form an adjustable angle with the ground surface, the tip of the nose can be easily inserted under the goods for displacement. This also has an additional advantage during setting-down since the goods are then placed in controlled manner. The movement of the nose takes place substantially around a shaft extending substantially perpendicularly of the longitudinal direction of the forks. The movement which the nose can make here preferably lies in the range of 0 to −5 degrees, i.e. the tip points slightly downward.

The movable nose is preferably provided substantially from a wear-resistant material. Because the nose according to the invention is provided as a component in which the load resulting from, among other factors, scraping and being dragged over the ground is concentrated, the overall lifespan of the stacker according to the invention can be increased by using wear-resistant material for the nose. The movable nose can also be replaced in simple manner by being provided detachably in simple manner on the forks of the stacker according to the invention. Damage to for instance the support part hereby remains limited, whereby the lifespan thereof is greatly increased. This limits the overall maintenance costs for the stacker according to the invention.

In a further advantageous preferred embodiment according to the present invention the support part is provided with a third double roller device.

By providing a third double roller device, which is provided in the support part, the support part will also contribute in effective manner toward picking up and setting down of goods. The support wheels or rollers are provided here as lower roller elements, and additional upper roller elements are arranged which engage on the goods in a first position.

The upper roller elements are preferably provided adjustably relative to the lower roller elements using adjusting elements. By providing the adjusting elements the upper roller elements can be moved relative to the lower roller elements of the third double roller device in the support part. This is important since the support part with the support wheel also moves over a ground surface during displacement of the goods, whereby without the adjusting elements the upper rollers would also co-displace during the displacement as a result of the contact between the upper and lower roller elements. In view of the speed of the displacement of the stacker according to the invention and the limited diameter of the upper roller elements of this third double roller device, these rollers would rotate extremely quickly, whereby they would wear quickly. The adjusting elements ensure that in unloaded state the upper roller elements are located a short distance from the lower rollers. Using these adjusting elements the load on the upper rollers therefore occurs particularly during picking up and setting down of goods. This is because during transport the goods rest on the carrier part and in most cases there will be no direct contact between the goods and these upper rollers of the double roller device of the support part.

The adjusting element preferably comprises a spring element. A small mutual distance between the upper and the lower roller elements is guaranteed in the unloaded state in effective manner by providing a spring element. the desired contact can be realized in simple manner during pick-up and set-down by compression of this spring element as a result of the goods.

The invention further also relates to forks and a method for displacing goods, comprising of providing a stacker as described above.

Such forks and method provide the same effects and advantages as described above for the stacker. The forks according to the invention can be provided as module in order to convert existing stackers in relatively simple manner to a stacker according to the invention as described above.

BRIEF DESCRIPTION OF THE DRAWINGS

Further advantages, features and details of the invention are elucidated on the basis of preferred embodiments thereof, wearing reference is made to the accompanying drawings, in which.

DESCRIPTION OF THE INVENTION

Figure 1:
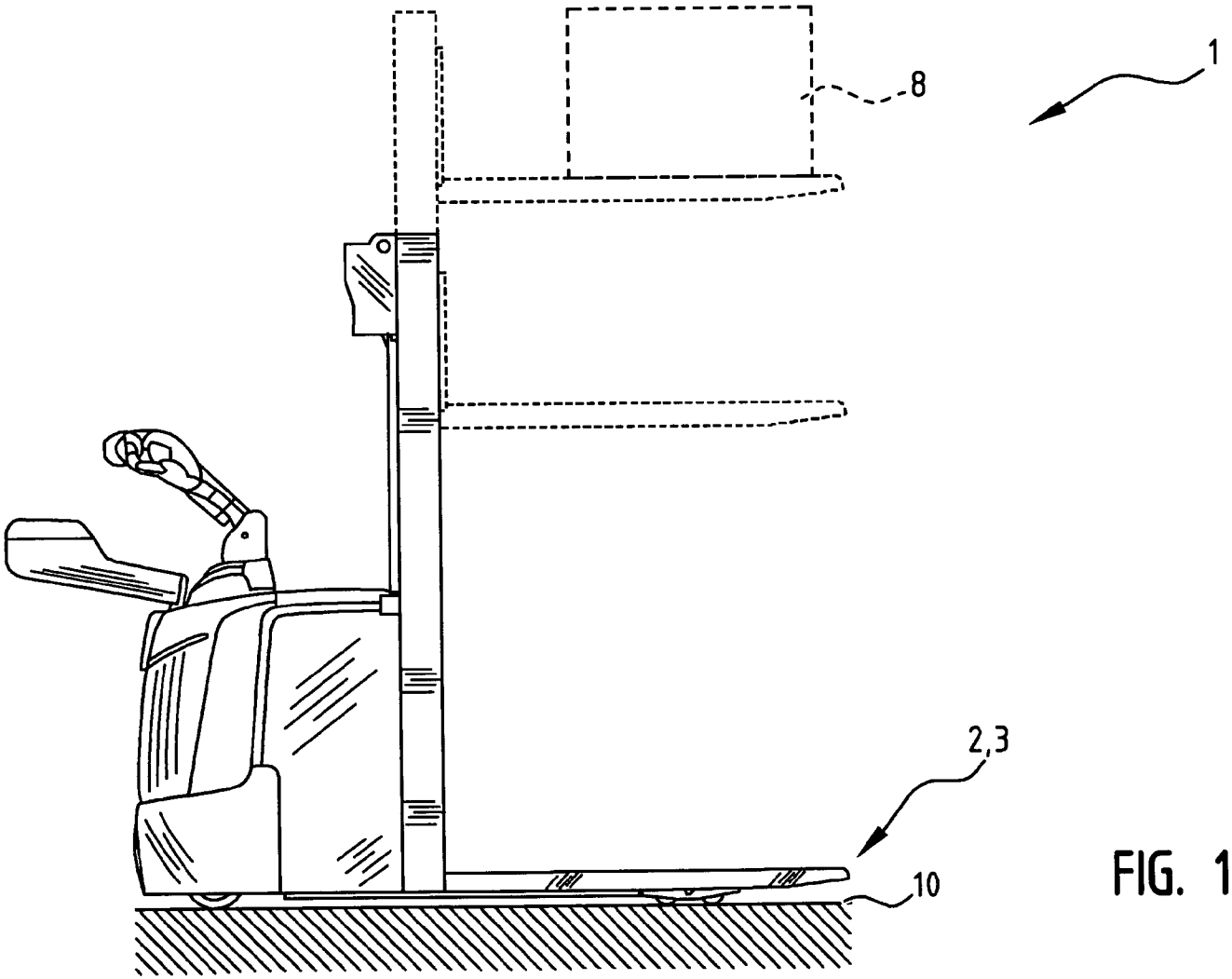
FIG. 1 shows a view of a stacker according to the invention.

Shown in FIG. 1 is a stacker 1 equipped with two load platforms 2,3 according to the invention. Load platforms 2,3 are embodied as forks. A fork 3 has two rows of roller elements 4,5 running along the length of the load platform. Load platform 2,3 has an upper surface with recesses 6. Recesses 6 are formed at a position where a corresponding roller element 7 of the second roller elements is located in the load platform.

Figure 2:
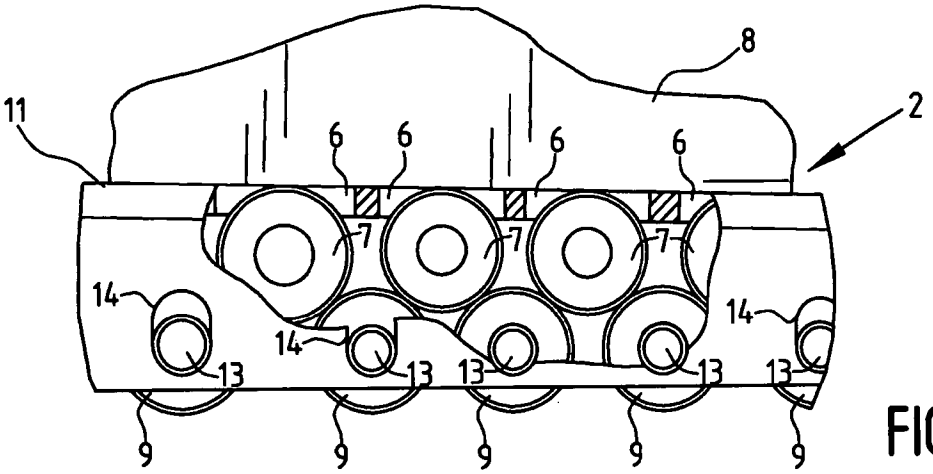

FIG. 2 shows a detail of FIG. 1. It shows the situation of fork 2 when fork 2 is held in the air. The first roller elements 9 hang from their shafts 13 in elongate slots 14 of fork 2. The second roller elements 7 are supported by roller elements 9 located thereunder. The second roller elements 7 are arranged higher, although still between the first roller elements 9 located at regular mutual distances. The first roller elements 9 of the fork make no contact with supporting surface 10, the ground, nor with the cargo 8. The cargo is supported by upper surface 11,12 of fork 2,3. Stacker 1 is free to be moved. This takes place in the usual manner.

Figure 3:
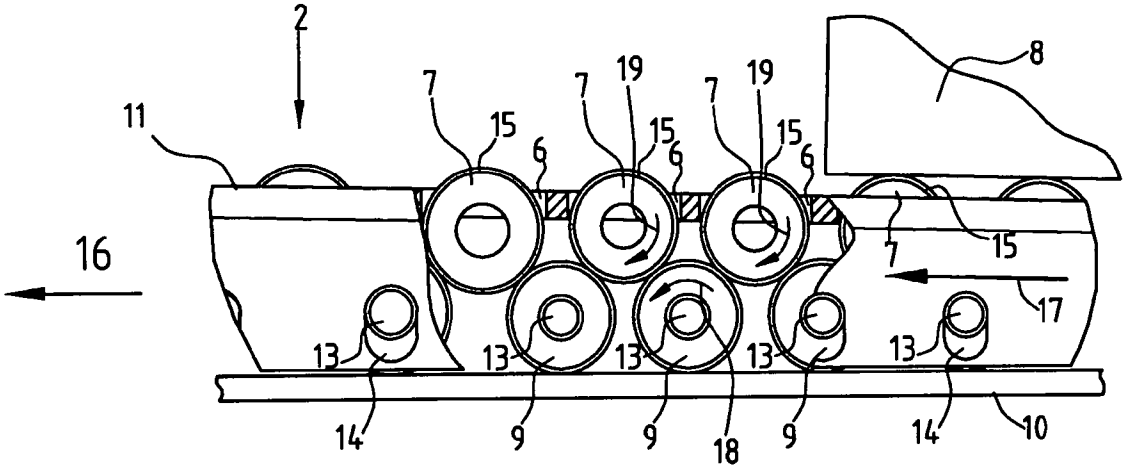
FIGS. 2 and 3 show views of the double roller device.

FIG. 3 shows fork 2 when fork 2 is placed on ground surface 10. The load platforms in the form of forks 2,3 have been moved downward relative to the position in FIG. 2. Forks 2,3 lie in the lowest position. The undersides of forks 2,3 make contact with ground surface 10. Roller elements 7,9 are hereby moved upward relative to fork 2,3, whereby roll surface 15 of the second roller elements 7 protrude through recesses 6 in upper surface. 11 of fork 2. These roller elements 7 bear the cargo 8.

A stacker 1 moves rearward as according to arrow 16. Fork 3 slides out from under the cargo 8. Roller elements 7,9 ensure that the cargo is held in the same position relative to ground surface 10, and is thus rolled off the forks 2,3.

FIG. 3 shows the roller elements situated vertically in a higher position relative to FIG. 2. First roller elements 9 make contact with ground surface 10. Shafts 13 are situated higher in elongate slots 14. Roll surface 15 of second roller elements 7 protrudes through recesses 6 of upper surface 11 of fork 2 and engage on cargo 8.

During a movement of fork 2 as according to arrow 17 when stacker 1 moves as according to arrow 16, first roller elements 9 will move counter-clockwise as according to arrow 18. Owing to the contact between the roll surfaces of roller elements 7,9 the second roller elements move as according to arrow 19. Cargo 8 will remain stationary relative to floor surface 10.

The illustration also shows the moment at which a cargo 8 is engaged before it is displaced. Forks 2,3 slide under cargo 8 in similar manner, but in opposite direction, and cargo 8 is scooped up.

Figure 4:
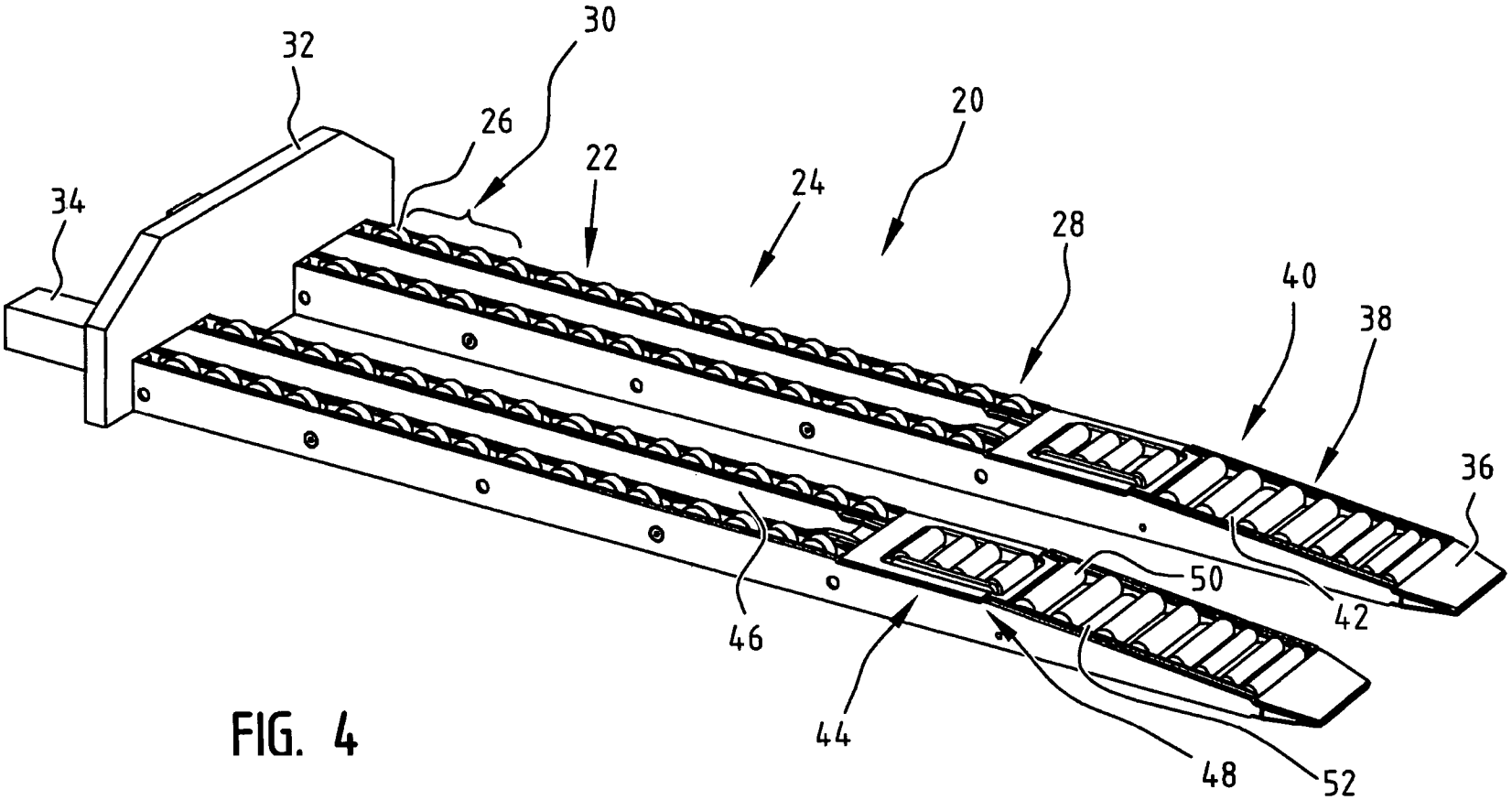
FIG. 4 shows a view of the forks of the stacker of FIG. 1.

In a first embodiment 20 (FIG. 4) forks 2,3 are provided with a first double roller device 22 in carrier part 24. In a currently preferred embodiment carrier part 24 is provided here along the greater part of the length at a small downward sloping angle of about half a degree in the direction of the front side of fork 2,3. Diameters of rollers 26 are preferably adapted hereto, as is the mutual distance between rollers 26. In the shown embodiment four rollers 26 of upper row 28 at a time are provided as modular element 30. Provided on the side of the frame is coupling plate 32 with which a connection is made to the rest of stacker 1 using beam 34 and other components. Situated on the front side of forks 20 is a nose 36.

Also present on the front side of fork 20 is a second roller device 38 which slopes downward so that it can be placed more easily under goods 8. Roller device 38 has for this purpose as upper rollers 40 rollers of a differing diameter, wherein the diameter decreases in the direction of nose 36. The lower row of rollers of roller device 38 has a corresponding diameter. Support part 44 is connected with arm 46 to the frame.

Figure 5:
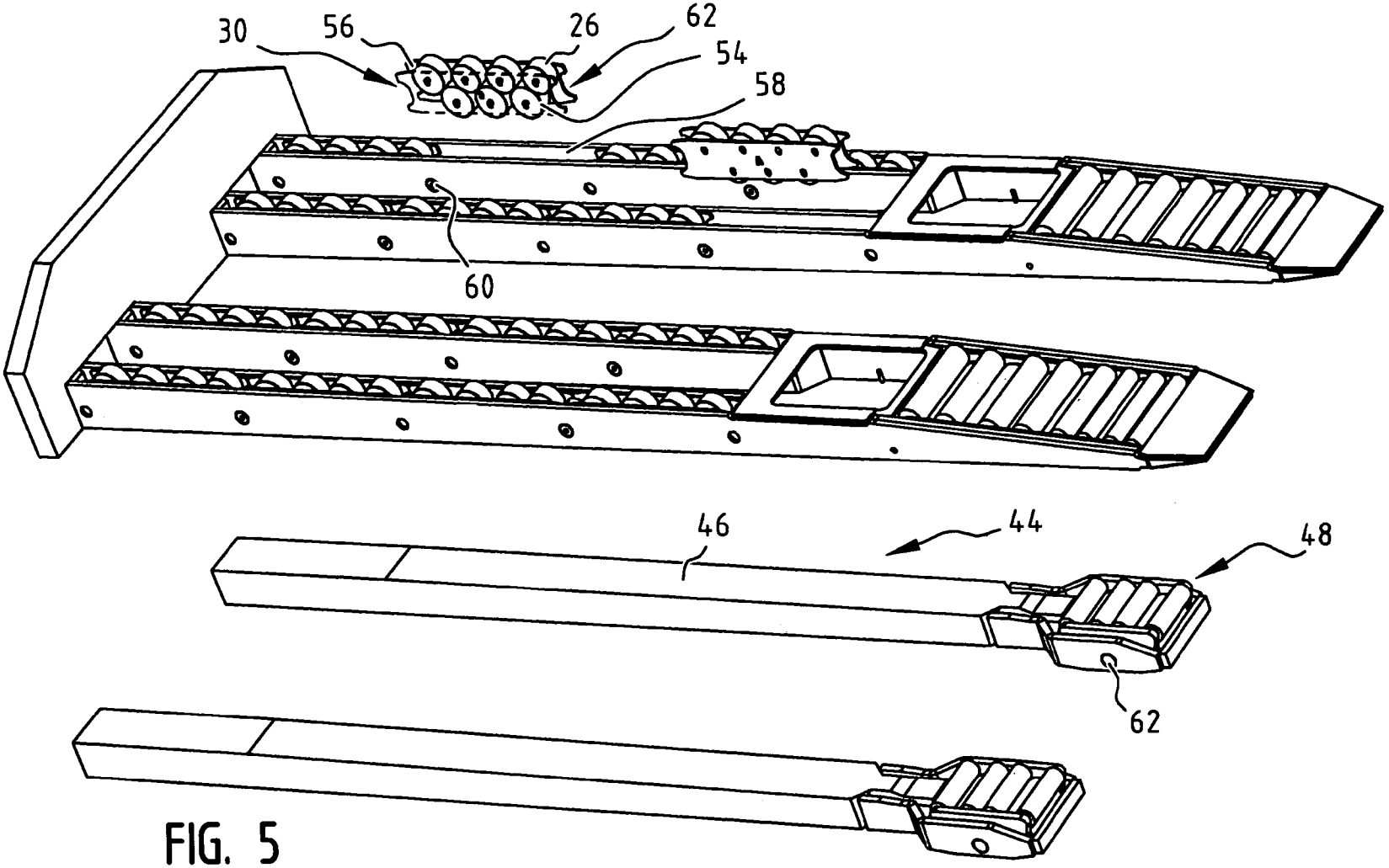
FIG. 5 shows a view of the forks of FIG. 4 in detached state.

Support part 44 is further provided with a third roller device 48 with upper rollers 50 and lower rollers 52. In the shown embodiment module 30 (FIG. 5) comprises four upper rollers 26 and a number of lower rollers 54. Rollers 26, 54 are connected to each other with two plates 56 provided movably relative to guides 58 of carrier part 24. Via shafts 60 fitting into recesses 62 element 30 can move relative to guides 58. If carrier part 24 is positioned on ground surface 10, lower rollers 54 will push module 30 upward so that upper rollers 26 engage on cargo 8. If carrier part 24 is moved upward, module 30 will drop downward via recess 62 relative to guides 58 so that the upper side of rollers 62 are situated below the carrying surface of carrier part 24. Support part 44 is provided in the shown embodiment with a tilt shaft 62 so as to be able to compensate to some extent for an uneven ground surface 10.

Figure 6:
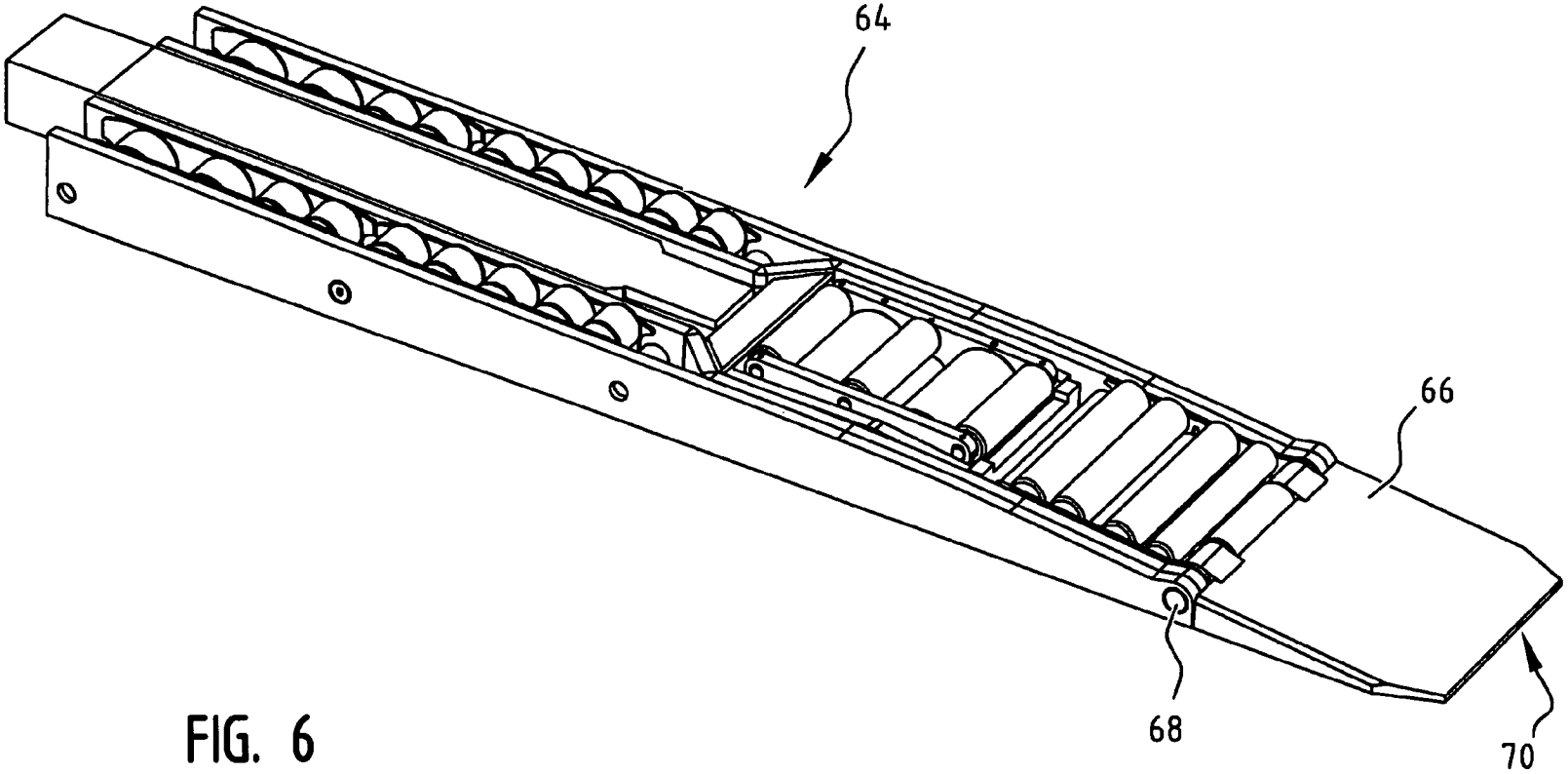
FIG. 6 shows a view of an alternative embodiment of the fork of the stacker.
Figure 7:
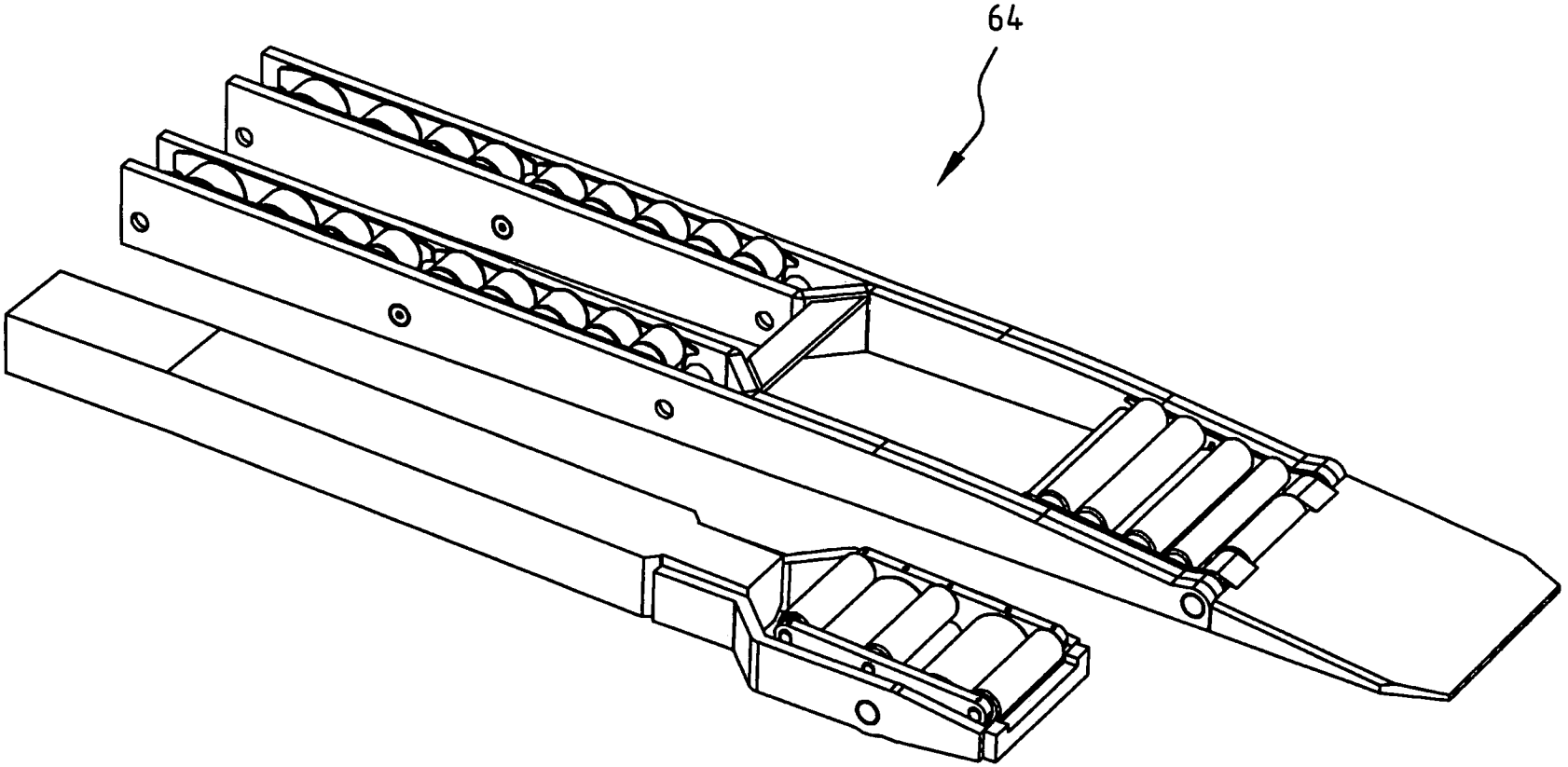
FIG. 7 shows a view with the individual components of the fork of FIG. 6.

In an alternative embodiment 64 (FIG. 6) of forks 2,3 a movable nose 66 is provided on the front side. In the shown embodiment nose 66 rotates around shaft 68 through a downward angle of about 5 degrees. Nose 66 is manufactured from a wear-resistant material. Nose 66 ends toward the front in a tip 70 which can be placed under a cargo. Forks 64 (FIG. 7) are further provided with the same elements as forks 20.

Figure 8:
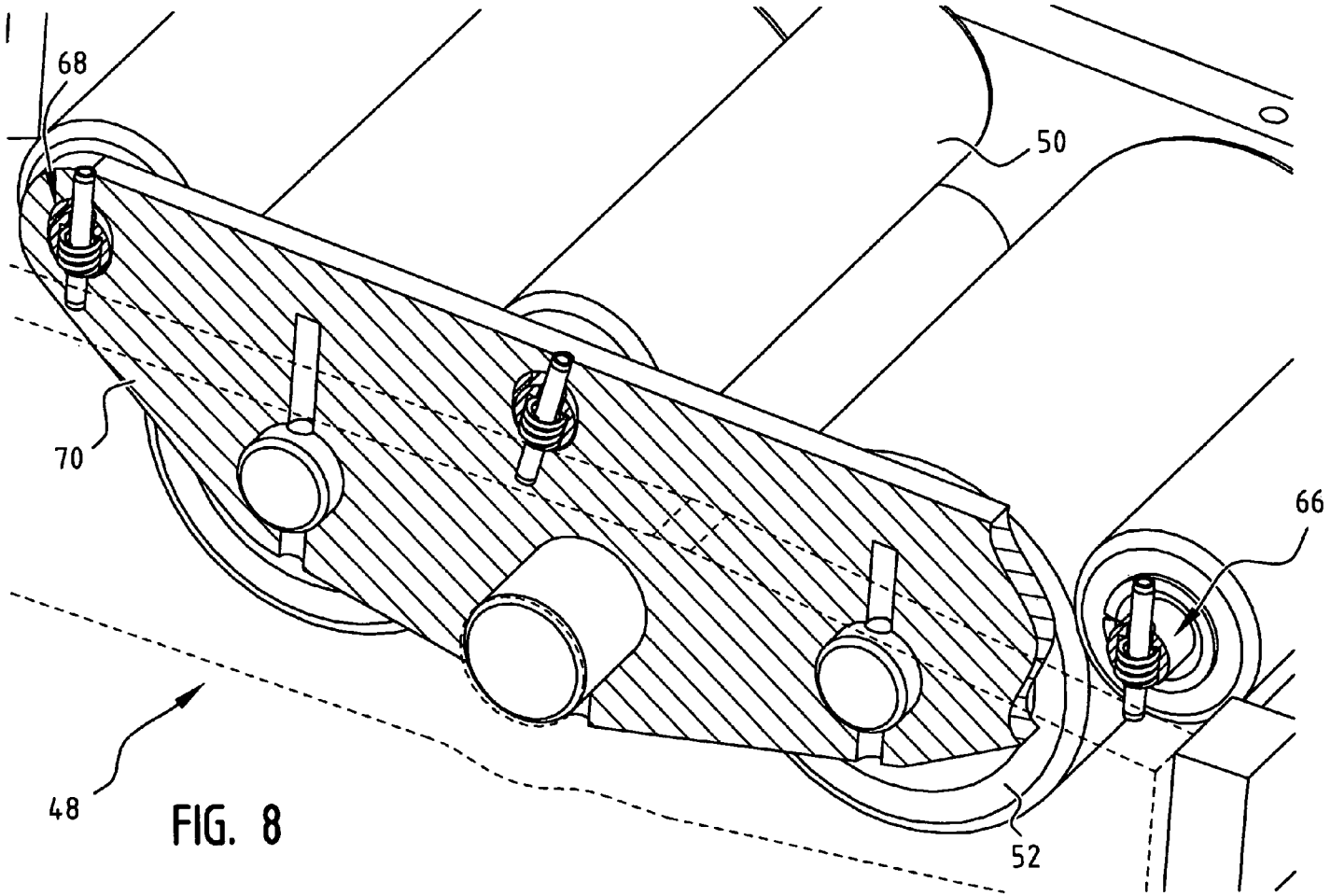
FIG. 8 shows a view of the adjusting element in the case of the third roller device of the stacker of FIG. 1.

In the shown embodiment forks 20, 64 are provided with a third double roller device 48 (FIG. 8). Roller device 48 is provided with lower rollers 52 which move over ground surface 10, and upper rollers 50. Via recess 68 in plate 70 a spring element 66 holds rollers 50 at a mutual distance from lower rollers 52 in the unloaded state. In the situation shown in FIG. 8 upper rollers 50 are shown in a loaded state, wherein cargo 8 is not shown.

When a cargo 8 is picked up, forks 2,3 are placed under cargo 8. Cargo 8 can for instance be situated here on a pallet, slip sheet or other carrier element. In a possible embodiment nose 66 is moved downward to some extent around shaft 68 so that tip 70 can as it were be pressed under cargo 8 without the other parts of stacker 1 being subjected to wear. The cargo is pushed onto forks 2,3 through use of the roller device. During pick-up use is made here of the second roller device 38 on the front side of forks 2,3, wherein in the shown embodiment use is also made of the third roller device 48 of the support part for the purpose of positioning cargo 8 on the straight carrier part 24 using the first roller device 22. Forks 2,3 are subsequently lifted to some extent, after which cargo 8 is transported. At the desired location forks 2,3 are moved downward again until they rest on support part 44, following which goods or cargo 8 roll off forks 2,3 by reversing the stacker 1 and are set down at the desired position.

The present invention is by no means limited to the above described preferred embodiments thereof. The rights sought are defined by the following claims, within the scope of which many modifications can be envisaged.

The invention claimed is:

1. A stacker for displacing goods, comprising:

a frame;

forks connected to the frame and provided with a support part having at least one support wheel, and a carrier part provided movably relative to the support part for carrying the goods for displacement, wherein the carrier part is provided with a double roller device, wherein the double roller device comprises a number of first roller elements located a distance from each other and having a roll surface, and a number of second roller elements located above the first roller elements and having a roll surface, and wherein the roll surface of the first roller elements lies against the roll surface of the second roller elements, wherein the first and second roller elements engage movably in vertical direction on the frame in a guided manner so as to extend the second roller elements in selective manner above the upper surface of the load platform, wherein the support part is provided with a third double roller device, wherein upper roller elements are provided adjustably relative to lower roller elements using adjusting elements, and wherein the adjusting elements comprise a spring element.

2. The stacker as claimed in claim 1, wherein the first and second roller elements are connected in groupwise manner to a plate element provided movably relative to the carrier part.

3. The stacker as claimed in claim 1, wherein a second double roller device is provided on a front side of the forks.

4. The stacker as claimed in claim 3, wherein the diameter of roller elements of the second double roller device decreases toward the front side of the stacker.

5. The stacker as claimed in claim 1, further comprising a nose movable relative to the fork.

6. The stacker as claimed in claim 5, wherein the movable nose is provided substantially from a wear-resistant material.

7. A fork suitable for a stacker as claimed in claim 1.

8. A method for displacing goods, comprising the step of providing a stacker and forks as claimed in claim 1.

* * * * *